US005622111A

United States Patent [19]

Bachmeir et al.

[11] Patent Number: 5,622,111

[45] Date of Patent: Apr. 22, 1997

[54] FORM CYLINDER WITH PRINTING FOIL WIND CONTROL

[75] Inventors: Xaver Bachmeir, Augsburg; Eckhard Tusché , Bobingen; Johannes Ruschkowski, Augsburg, all of Germany

[73] Assignee: MAN Roland Druckmaschinen AG, Offenbach am Main, Germany

[21] Appl. No.: 528,953

[22] Filed: Sep. 15, 1995

[30] Foreign Application Priority Data

Sep. 15, 1994 [DE] Germany ..... 44 32 817.6

[51] Int. Cl.[6] ..... B41J 7/00

[52] U.S. Cl. ..... 101/415.1; 101/477; 101/479

[58] Field of Search ..... 101/415.1, 477, 101/479, 375, 378, 382.1, 383, 216

[56] References Cited

U.S. PATENT DOCUMENTS

| | | | |
|---|---|---|---|
| 3,043,219 | 7/1962 | Dietrich | 101/378 |
| 3,750,573 | 8/1973 | Haeusler et al. | 101/415.1 |
| 3,984,241 | 10/1976 | Schrempp et al. | 101/477 |
| 4,856,425 | 8/1989 | Köbler | 101/216 |
| 5,062,362 | 11/1991 | Kemp | 101/348 |
| 5,413,043 | 5/1995 | Furhmann | 101/415.1 |
| 5,435,242 | 7/1995 | Kush et al. | 101/415.1 |

FOREIGN PATENT DOCUMENTS

| | | |
|---|---|---|
| 4110309 | 10/1991 | Germany . |
| 4303872 | 10/1993 | Germany . |

*Primary Examiner*—Eugene H. Eickholt
*Attorney, Agent, or Firm*—Cohen, Pontani, Lieberman, Pavane

[57] ABSTRACT

A form cylinder (1) for use in a printing machine including at least one cassette (40) and preferably multiple cassettes (40 to 43), each of which is removable from the form cylinder (1) through an opening (37) in a side wall (2). Each of the cassettes contains winding rollers (4) and a printing form extending between the winding rollers. The winding rollers are driven by an externally positioned driving device such as an electric motor (3) to wind and unwind the printing form. The winding rollers are connected to the driving device by a coupling (12) which is movable between an engaged position in which a shaft of each winding roller is connected to a shaft associated with the driving device and an unengaged position in which the winding rollers are not connected to the driving device.

21 Claims, 5 Drawing Sheets

FORM CYLINDER WITH PRINTING FOIL WIND CONTROL

BACKGROUND OF THE INVENTION

1. Field of the Invention

The present invention relates to a form cylinder in a rotary printing machine and, more particularly, to a form cylinder including a printing foil, covering its outer surface, the respective ends of the printing foil being attached to winding rollers rotatably mounted within the interior of the form cylinder and including a driving device for turning the winding rollers.

2. Description of the Prior Art

Form cylinders of this type are well-known. For example, German Patent Application DE 43 03 872 A1 discloses a form cylinder covered on its outer surface by a printing foil constituting the printing form for the particular printing process being carried out. The beginning and end of the printing foil are stored in the interior of the form cylinder and connected between a first roller and a second roller; the first roller having the unused printing foil wound around it and the second roller having the used or printed printing foil wound around it. The form cylinder includes a driving device for driving either the first or both rollers in order to transport new, unused printing foil from the first roller onto the outer surface of the form cylinder and at the same time to wind the used or printed portion of the printing foil around the second roller after the printing image of the printing foil has been printed on the outer surface of the form cylinder. The portion of the printing foil which then rests on the outer surface of the form cylinder constitutes the basis for a lithographic printing process. Either the printing foil already carries a finished printing image, or it is directly imaged within the printing machine, using either the ink-jet process, thermotransfer, or laser beams, especially laser ablation.

In order to move the printing foil forward the machine includes a driving device, for example, a motor. The driving device is located within the form cylinder.

SUMMARY OF THE INVENTION

It is accordingly an object of the present invention to provide a form cylinder covered by a printing foil which can be moved in the circumferential direction and transported between rollers of the form cylinder in a simple manner.

The driving device of the present invention is located outside the form cylinder, namely, in the vicinity of a side wall of the printing machine to provide a more space efficient device. The interior space of the form cylinder is now fully available to accommodate the winding rollers and energy no longer needs to be supplied into the interior of the form cylinder.

The present invention also advantageously allows the form cylinder to be surrounded by multiple printing foils, for example, four printing foils each of different ink colors, thus it is also possible to move all four printing foils forward using a single driving device.

The present invention also ensures that the printing foils are secured against movement after the transportation process has ended and cannot slip during the printing process.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

BRIEF DESCRIPTION OF THE DRAWINGS

In the drawings in which like reference numerals identify similar elements throughout the several views.

DETAILED DESCRIPTION OF THE PRESENTLY PREFERRED EMBODIMENT

Figure 1:
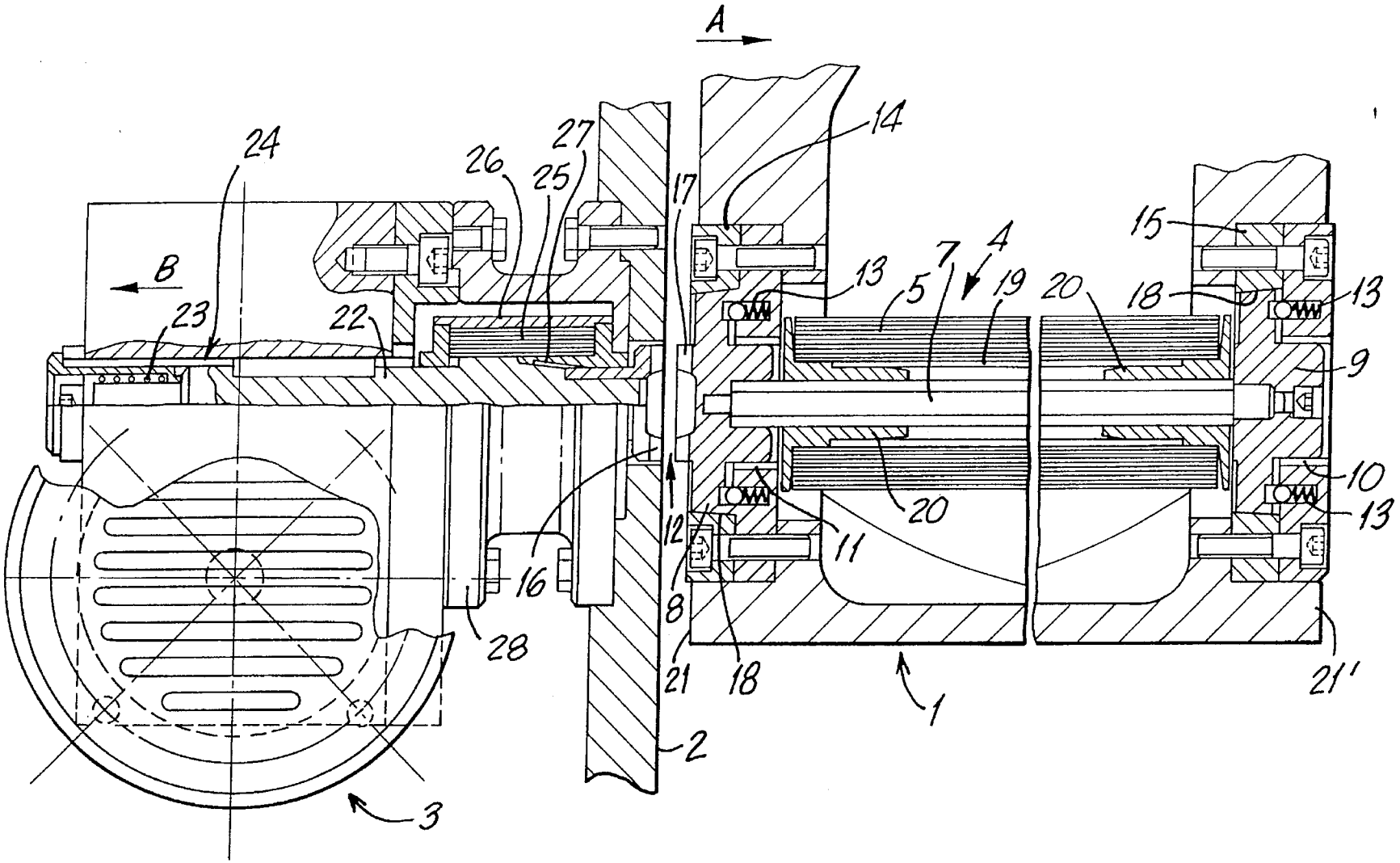
FIG. 1 shows a cross-sectional view of a driving device, side wall and form cylinder in accordance with the present invention.
Figures 2A, 2B:
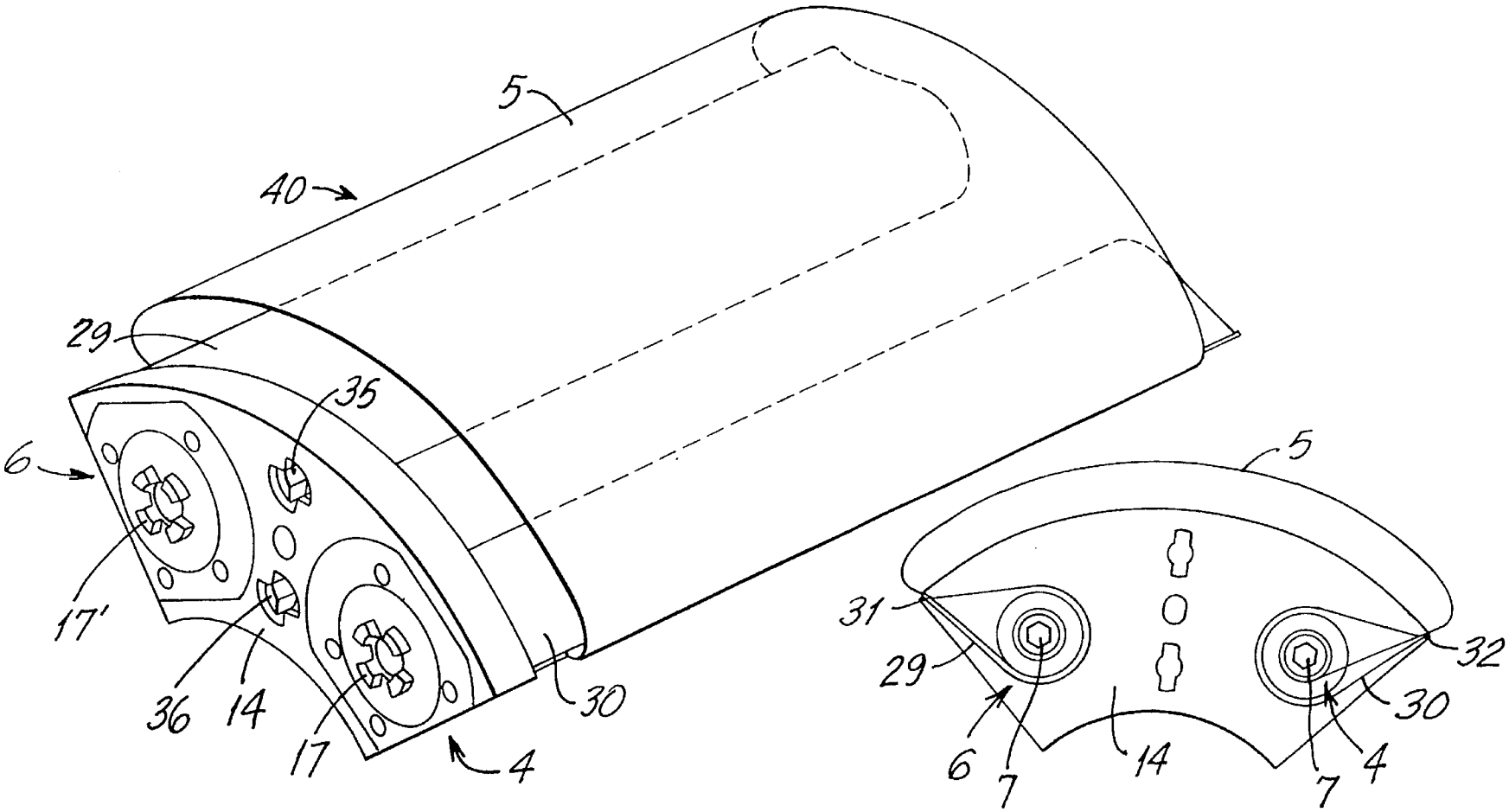
FIG. 2*a* shows a top perspective view of a cassette including a printing foil and two winding rollers in accordance with the present invention.
FIG. 2*b* shows a front cross sectional view of the cassette in FIG. 2*a;*

FIG. 1 shows a form cylinder 1 mounted in a side wall 2. Mounted on the opposite side of the wall 2 is a driving device 3. The driving device 3 is depicted as an electric motor in FIG. 1 and serves to turn a winding roller 4 mounted in the interior of the form cylinder 1 and surrounded in multi-layer fashion by a printing foil 5. The driving device 3 may alternatively be a pneumatic motor, an hydraulic motor, a gear connectable to and disconnectable from a driving element of the printing machine or any other device capable of performing the above mentioned function. When the winding roller 4 is turned, the printing foil 5 is wound off and onto the winding roller 4 by a second winding roller 6 based upon the direction of rotation imparted by the driving device 3 as can be seen in FIGS. 2*a* and 2*b*. The second winding roller 6 may also be driven by the driving device 3. The winding roller 4 is mounted in the form cylinder 1 by a shaft 7 having a polygonal cross-section. The shaft 7 includes shaft journals 8 and 9 which mount the winding roller 4 in the form cylinder 1 through slide bearings 10, 11. The winding roller 4 is rotatable in the form cylinder 1 only as long as the winding roller 4 and the shaft journals 8, 9 are pushed out of engagement with holding segments 14 and 15 by the electric motor 3 through a coupling 12 which acts against a force exerted by springs 13. As long as the claws 16 and 17 of the coupling 12 are disengaged from one another and the claws 16 do not push the claws 17, together with the winding roller 4, in the direction shown by arrow A in FIG. 1, the winding roller 4 remains mounted in a frictionally-engaged manner in the holding segments 14 and 15 through the connection of the shaft journals 8 and 9. To this end, the shaft journals 8 and 9 and the holding segments 14 and 15 have conically shaped walls 18, the gradient of which determines the amount of cohesive friction.

The winding roller 6 is either driven together with the winding roller 4 by the same drive, e.g. the electric motor 3, or separately by a different drive via the claws 17' of a coupling corresponding in design to the coupling 12 as can be seen in FIG. 2*a*.

Figure 3:
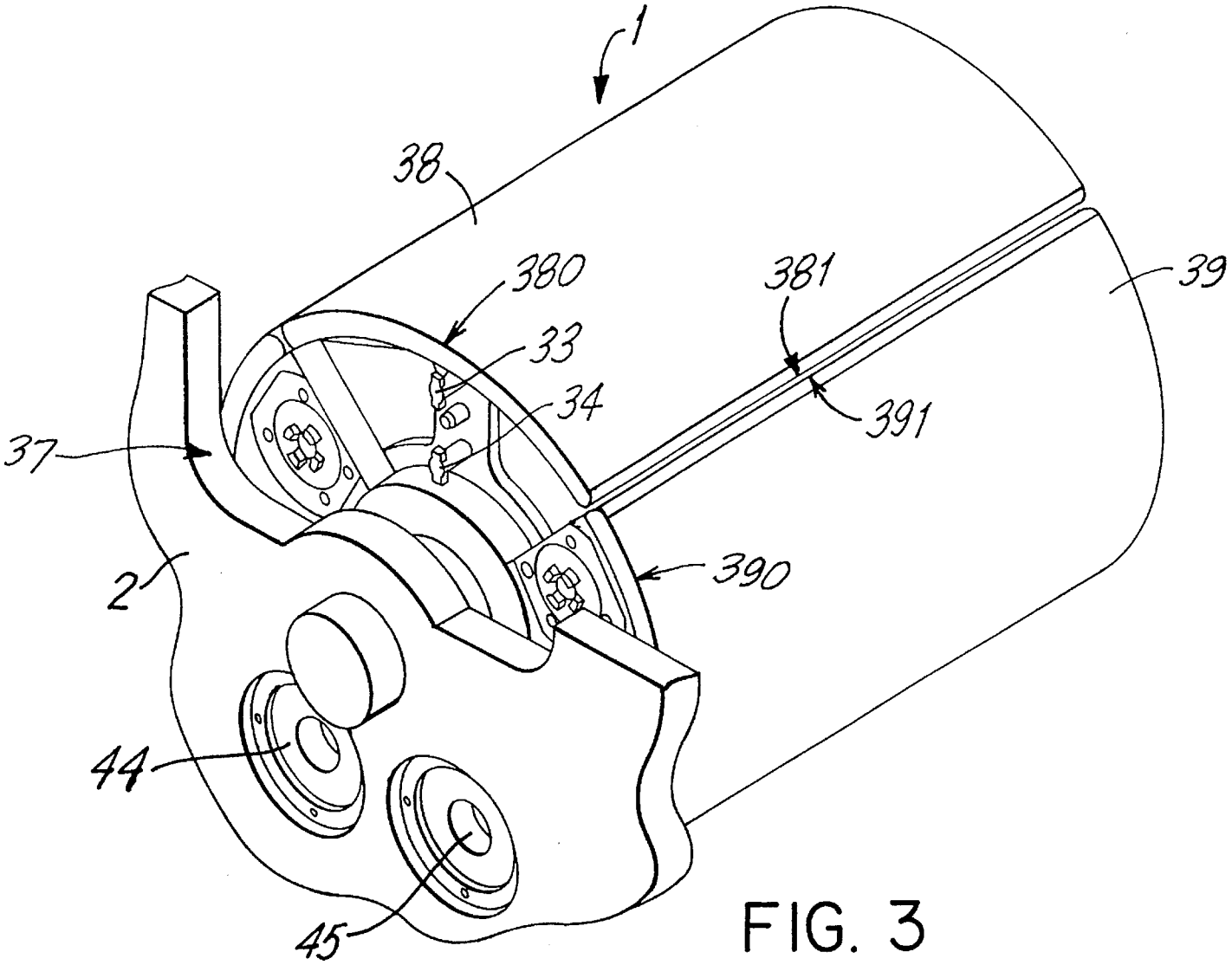
FIG. 3 shows a top perspective view of the form cylinder in accordance with the present invention mounted in the side wall.

The winding roller 4 carries the printing foil 5, for example, on a tube 19 and spacing pieces 20 positioned thereabout. The tube 19 may be made of cardboard or any other suitable material. The winding roller 4, together with the winding roller 6 and the printing foil 5 wound around the winding rollers 4, 6, can be passed through an opening 37 in the side wall 2 at the drive-side end-face 21 of the form cylinder 1, and thus be removed from or placed in the form cylinder 1 as is shown in FIG. 3. When the winding rollers 4, 6 are removed, only the shaft journal 9 remains in the form cylinder 1. The shaft journal 8 is preferably connected to the winding roller 4 or 6 and removable together with it.

During the printing process, the claws 16 and 17 of the coupling 12 are separated from one another. The claws 16 of the coupling 12 are connected to an anchor 22 that operates with a stator 25. The anchor 22 is mounted on and axially movable along a shaft 24, which, when the coupling 12 is closed, drives the shaft 7 of the winding roller 4. A tension spring 23 exerts a tension force causing the anchor 22 mounted on the shaft 24 to be pulled away from the claws 17 of the coupling 12 in the direction of an arrow B when no current flows through the stator 25.

When the form cylinder 1 is at a standstill and the printing foil 5 is to be moved forward from the winding roller 6 to the winding roller 4, an electric current is caused to flow through the coils of the stator 25, causing the material of the stator's surrounding housing 26 to become magnetized. The material of the housing surrounding the stator 25 may be magnetized but is not permanently magnetic. Through magnetic induction, the anchor 22 is magnetized with a magnetic field acting against the force exerted by the tension spring 23 so that the anchor 22 is drawn toward the housing 26 in the direction of arrow A, until the gap 27 between the anchor 22 and the housing 26 no longer exists. The magnetic induction, in other words, is stronger than and is able to overcome the force exerted by the tension spring 23 on the anchor 22.

The claws 16 now engage with the claws 17 of the coupling 12, and the shaft 7 is driven by the electric motor 3 through the shaft 24 and coupling 12 in order to move the printing foil 5 forward.

The tension spring 23 may be replaced by a second anchor including a stator which anchor, upon the application of current to its stator, can be moved in opposition to the anchor 22 so that, when the transport of the printing foil 5 is complete, as current flows through the stator of the second anchor instead of the stator 25, this anchor as well as the anchor 22 would be drawn back in the direction of arrow B thus disengaging the claws 16 and 17 of the coupling 12. It is also possible to move the claws 16 of the coupling 12 in the direction of the claws 17 and to move them back again using other methods such as pressurized air or hydraulic fluid.

The electric motor 3 is attached to the side wall 2 via a spacing piece 28. The shaft 24 and the anchor 22 are rotatably mounted to the spacing piece 28.

Figure 4:
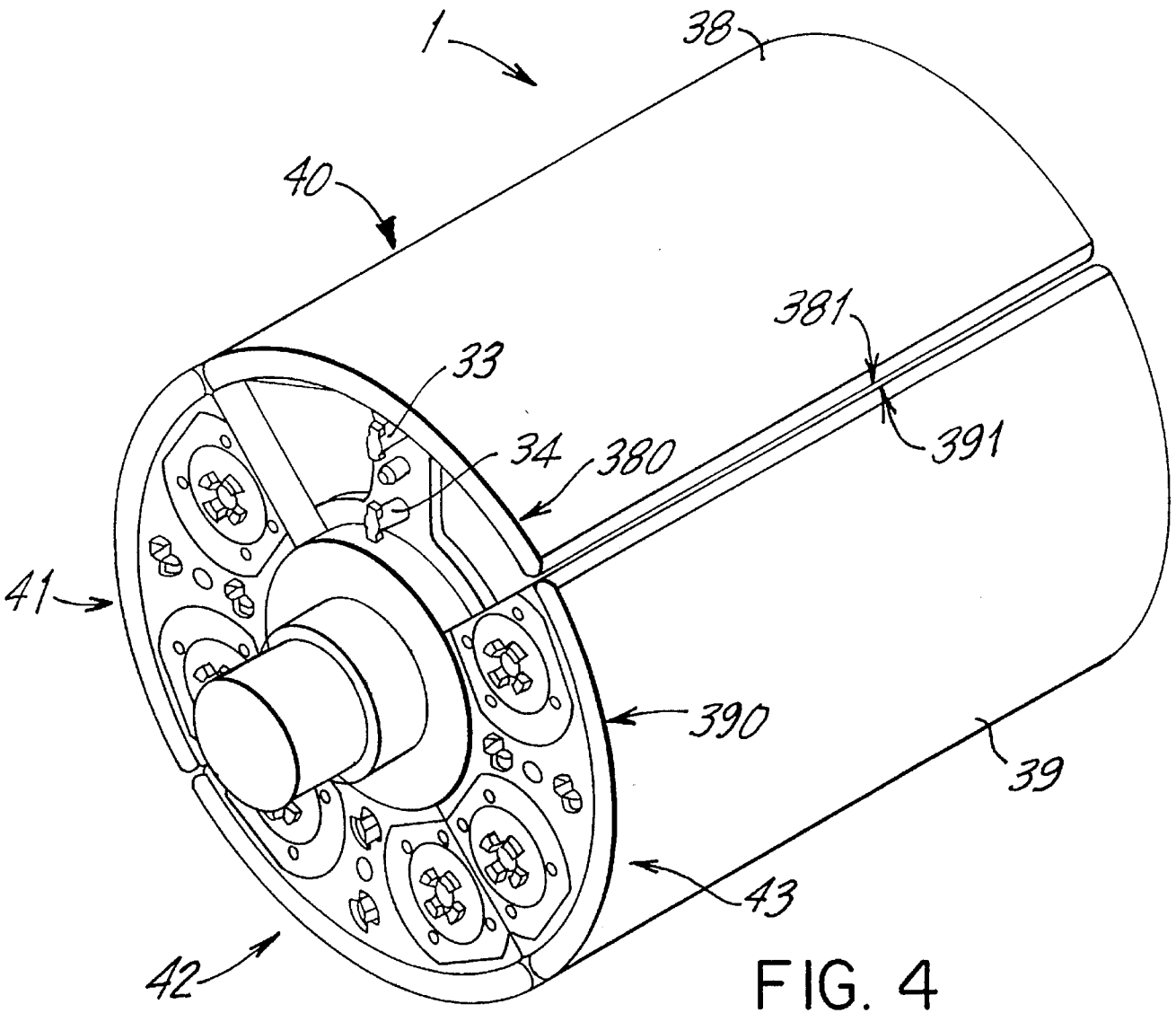
FIG. 4 shows a top perspective view of the form cylinder of FIG. 3 equipped with three cassettes.

The winding rollers 4 and 6 are mounted in the interior of sleeves 29, 30 as is depicted in FIG. 2*a*. The sleeves 29, 30 each have openings 31 and 32, respectively, through which the printing foil 5 extends as is depicted in FIG. 2*b*. The winding rollers 4, 6 are attached to an end face 21 of the form cylinder 1 facing the side wall 2 through a connection with the holding segment 14 and locking bolts 33, 34 passing through openings 35, 36 in the holding segment 14 as is depicted in FIG. 4. The sleeves 29, 30, the holding segment 14, the claws 17 and 17' for the couplings 12 and the winding rollers 4, 6 form a cassette 40 that is removable from the form cylinder 1. The cassette 40 is preferably removable from the form cylinder through an opening 37 at the end face 21. The cassette 40 removed from the form cylinder 1 may be replaced with a new cassette at anytime including after the printing foil 5 has been printed or when a printing foil 5 with another printing subject is needed for a new printing job.

Borings 44, 45 in the side wall 2 allow the couplings 12 for the winding rollers 4 and 6, respectively, to extend therethrough in order to drive the shafts 7 of the respective winding rollers 4 and 6. Only a single driving device 3 is necessary to rotate the winding rollers 4, 6 in the cassettes 40 to 43 and move the printing foils 5, even when multiple cassettes are mounted in the form cylinder 1, e.g. four cassettes 40, 41, 42 and 43 as depicted in FIG. 4. Before the printing foil 5 of a next cassette 40 41, 42 or 43 is moved the form cylinder 1 is turned by 90° so that the shafts 7 of the winding rollers 4, 6 of the appropriate cassette 40, 41, 42 or 43 are positioned with the claws 17, 17' of their couplings 12 aligned behind the borings 44, 45 as depicted in FIG. 3. Thus the claws 16 may engage the claws 17 and 17' and drive the winding rollers 4, 6 of the aligned cassette.

When the form cylinder 1 includes four cassettes 40, 41, 42 and 43, it is possible to carry out four-color printing in a rotary printing machine using a single form cylinder 1, if the four printing foils 5 in the cassettes 40 to 43, respectively, contain the images to be printed in black, blue, red and yellow.

Preferably, there is an imaging device in the vicinity of the outer surface of the form cylinder 1, for example, a print head for laser ablation or thermotransfer, in order to image the printing foil 5.

Each cassette 40, 41, 42 and 43 housed by the form cylinder as depicted in FIG. 3 is preferably removable therefrom through an opening 37 in the side wall 2. Each of the cassettes 40 to 43 contains winding rollers 4, 6, each winding roller being driven by a driving device 3, for example, an electric motor through the interconnection of the shaft 24, coupling 12 and shaft 7. Preferably, both the winding rollers 4 and 6 are driven by a single drive as the shaft 24 is coupled to the shafts 7 of each winding roller via their couplings 12.

In order to facilitate insertion of the winding rollers 4, 6 through the opening 37 and passing of the printing foil 5 over mantle segments 38, 39 of the form cylinder 1, the end-face edges 380, 390 of the mantle segments 38, 39 are preferably bevelled.

Figure 5A:
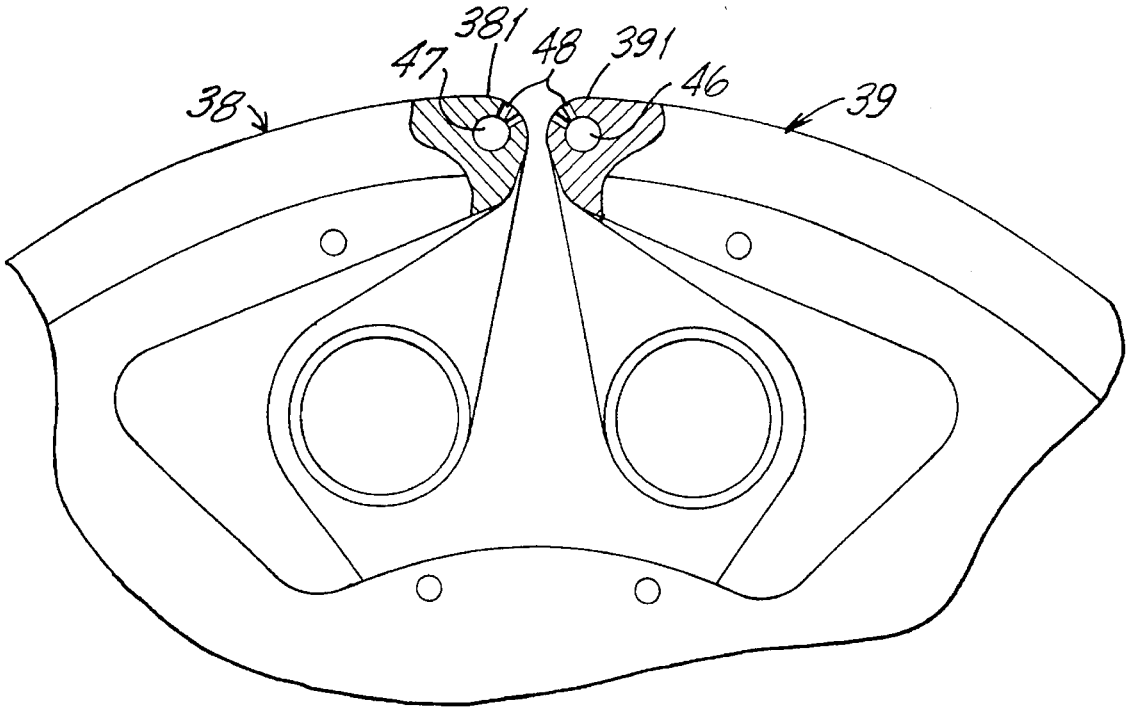
FIG. 5*a* shows a cross sectional view of an air supply used to support the transport of the printing foil in accordance with the present invention.

In order to support and facilitate the winding of the printing foil 5, air feeds 46, 47 having air outlets 48, are provided in the vicinity of the mantle-side edges 381, 391 of the mantle segments 38, 39 as depicted in FIG. 5*a*. When the winding roller 4 in the mantle segment 38 or the neighboring winding roller 6 in the mantle segment 39 is turned pressurized air is blown beneath the lower side of the respective printing foil 5 through the air feeds 46, 47 to greatly reduce the slide friction between the printing foil 5 and the mantle segment 38, 39.

Figure 5B:
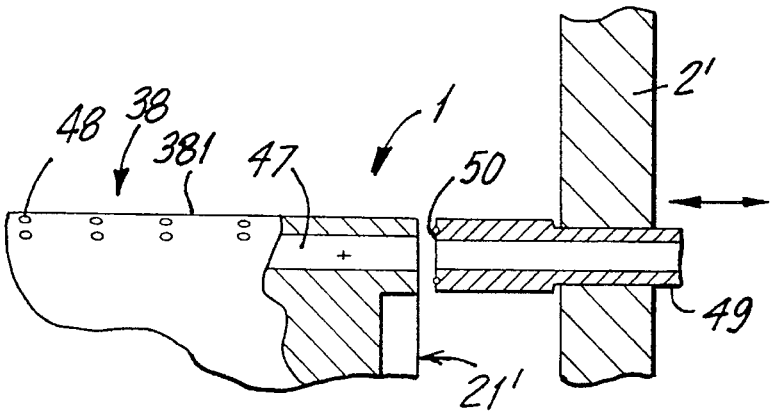
FIG. 5*b* shows a cross sectional view of the air supply of FIG. 5*a*.

A supply line 49 entering through the side wall 2' of the printing machine, can be moved towards or away from the end face 21' of the form cylinder 1 as depicted by the arrow C in FIG. 5*b* and is pressed onto the end-face 21' of the form cylinder 1 before the printing foil 5 is turned further. A rubber ring 50 seals the supply line 49 against the end-face 21' in this position.

The invention is not limited by the embodiments described above which are presented as examples only but can be modified in various ways within the scope of protection defined by the appended patent claims.

We claim:

1. A form cylinder for use in a rotary printing machine having a side wall, comprising:

a tubular body having an outer surface and end faces defining an interior space;

a first driving device positioned outside said interior space;

at least one cassette positioned within said interior space so as to be axially removable from an end face of the body, including:

first and second winding rollers each including an axis and being mounted within said interior space for rotation about said axis; and a printing foil extending between said first and second winding rollers and on said outer surface of said body; and first means, at an end face of the tubular body, for selectively coupling said first and second winding rollers to said first driving device, said first coupling means being axially movable between a first coupled position in which said first and second winding rollers are engaged with and driven by said first driving device to wind said printing foil and a second uncoupled position in which said first and second winding rollers are not engaged with said first driving device.

2. The form cylinder of claim 1, further comprising a second driving device and second means for selectively coupling said second winding roller to said second driving means.

3. The form cylinder of claim 1, wherein said first driving device is mounted to said side wall.

4. The form cylinder of claim 1, wherein said first driving device is one of an electric motor, hydraulic motor and pneumatic motor.

5. The form cylinder of claim 1, wherein said at least one cassette further comprises first and second holding segments connecting said first and second winding rollers when said first selective coupling means is in said second uncoupled position.

6. The form cylinder of claim 5, wherein said first and second holding segments further comprise a spring; and said at least one cassette further includes first and second pairs of conically shaped shaft journals, each pair connected to a respective one of said first and second winding rollers to provide a frictional engagement with said first and second holding segments against a force of said first spring.

7. The form cylinder of claim 1, further comprising means for controlling movement of said first selective coupling means between said first and second position.

8. The form cylinder of claim 7, wherein said control means is one of an electromagnetically operated device, pneumatically operated device, hydraulically operated device and spring operated device.

9. The form cylinder of claim 7, wherein said control means includes means for generating a magnetic inductance including a stator; an anchor inductively coupled to said stator; and a shaft, said anchor being movable along said shaft to move said first selective coupling means into said first coupled position.

10. The form cylinder of claim 9, wherein said anchor is temporarily magnetizable.

11. The form cylinder of claim 9, wherein said control means further includes a tension spring for acting against said anchor to move said first selective coupling means into said second uncoupled position.

12. The form cylinder of claim 5, wherein said first selective coupling means includes first and second claws, said first and second claws being engaged in said first position and disengaged in said second position.

13. The form cylinder of claim 6, wherein said first and second winding rollers each further include a shaft connected between and axially movable with a respective pair of said first and second journals.

14. The form cylinder of claim 1, further comprising first and second slide bearings each for mounting a respective one of said first and second winding rollers.

15. The form cylinder of claim 1, wherein said at least one cassette is removably connected within said form cylinder.

16. The form cylinder of claim 3, wherein said side wall has an opening positioned between said at least one cassette and said driving device for removing said at least one cassette from said form cylinder through said opening.

17. The form cylinder of claim 15, wherein said at least one cassette further includes first and second sleeves, each positioned about a respective one of said first and second winding rollers and including a passage, said printing foil positioned to extend through said passage of both said first and second sleeves.

18. The form cylinder of claim 1, wherein each of said first and second winding rollers include a polygonal shaft; a tube for receiving said printing foil positioned about said shaft and at least one spacing piece positioned between said shaft and said tube.

19. The form cylinder of claim 1, wherein said form cylinder further comprises a plurality of cassettes.

20. The form cylinder of claim 1, wherein said tubular wall includes a mantle segment defining said outer surface including a beveled end face for facilitating placement of said printing foil to cover said mantle segment.

21. The form cylinder of claim 20, wherein said mantle segment further includes first and second edges; and a plurality of air outlets extending through said first and second edges and operating in a first mode releasing pressurized air when said first means for selectively coupling is in said first position.

* * * * *